US005772033A

United States Patent [19]

Loftus et al.

[11] Patent Number: 5,772,033

[45] **Date of Patent: *Jun. 30, 1998**

[54] CONTAINER

[75] Inventors: Stephen Clive Loftus, Bloxwich; Andrew Christopher Cope, Wednesbury, both of United Kingdom

[73] Assignee: McKechnie UK Limited, West Midlands, United Kingdom

[ * ] Notice: The term of this patent shall not extend beyond the expiration date of Pat. No. 5,609,254.

[21] Appl. No.: 705,141

[22] Filed: Aug. 29, 1996

Related U.S. Application Data

[63] Continuation of Ser. No. 18,003, Feb. 16, 1993, Pat. No. 5,609,254.

[30] Foreign Application Priority Data

| | | | |
|---|---|---|---|
| Feb. 15, 1992 | [GB] | United Kingdom | 9203266 |
| Mar. 14, 1992 | [GB] | United Kingdom | 9205640 |
| Aug. 29, 1992 | [GB] | United Kingdom | 9218441 |

[51] Int. Cl.[6] ..... B65D 21/06

[52] U.S. Cl. ..... 206/506

[58] Field of Search ..... 206/503, 506

[56] References Cited

U.S. PATENT DOCUMENTS

| | | |
|---|---|---|
| 2,765,099 | 10/1956 | Lively . |
| 3,404,804 | 10/1968 | Frater et al. . |
| 3,951,265 | 4/1976 | Carroll . |
| 4,003,611 | 1/1977 | Smith . |
| 4,106,623 | 8/1978 | Carooll, et al. . |
| 4,573,577 | 3/1986 | Miller . |

FOREIGN PATENT DOCUMENTS

| | | |
|---|---|---|
| 1128878 | 4/1980 | Canada . |
| 0 056 665 | 7/1982 | European Pat. Off. . |
| 0 250 674 | 1/1988 | European Pat. Off. . |
| 93300951 | 6/1993 | European Pat. Off. . |
| 947 147 | 1/1975 | Germany . |
| 2 067 167 | 7/1981 | United Kingdom . |
| 2 104 486 | 3/1983 | United Kingdom . |

*Primary Examiner*—Joseph M. Moy
*Attorney, Agent, or Firm*—Adams Law Firm, P.A.

[57] ABSTRACT

The drawings show part of a nesting and stacking container. A support member 22 has a nesting position P1 which allows another container to nest in the container 10. The supporting member 22 can move to a chosen one of two stacking positions P2,P3 at which the member 22 can support the base of a container stacked above. Movement between the positions P1, P2 and P3 is achieved by a combination of pivotting the member 22 about an axis at 24, and moving the pivot axis relative to the container. Various other arrangements for mounting the support member 22 on the container are also described.

37 Claims, 5 Drawing Sheets

CONTAINER

This application is a continuation application of U.S. application Ser. No. 08/018,003 filed Feb. 16, 1993, now U.S. Pat. No. 5,609,254.

FIELD OF THE INVENTION

The present invention relates to containers.

BACKGROUND TO THE INVENTION

A conventional form of stacking and nesting container comprises two bail arms, stacking bars or support bars pivotally attached to and extending between the sides of the container, usually at opposing ends of the container. Each bail arm can be moved from a storage (or nesting) position to a position in which it can support a second like container stacked on top of a first container. When the bail arms are in the storage positions, they do not obstruct a second container, which can therefore nest in the container below. However, such bail arms can sometimes result in inefficient use of the capacity of the containers, because the fixed volume defined between the bases of two stacked containers is only efficiently used when the containers are full to the height between the bases.

It is an object of the present invention to obviate or mitigate these disadvantages.

SUMMARY OF THE INVENTION

According to the present invention there is provided a container comprising a support member mountable on the container at a stacking position in which a second container may be rested on the support member to form a stack, the support member being movable between any of a plurality of stacking positions as aforesaid to support a second container at respective positions above the container base.

At the stacking positions, the support member preferably supports a second container at respective heights above the container base. Preferably the support member also has a nesting position in which the support member allows a second like container to be nested in the container. There may be at least two vertically aligned stacking positions.

The container may comprise mounting means operable to mount the support member on the container and so arranged as to allow the support member to move as aforesaid.

The mounting means may include a projection which is confined, in use, to a predetermined range of locations to limit the range of movement of the support means. The projection may be confined by surfaces which do not continuously bound the region in which the projection is confined.

Preferably the mounting means allow the support member to pivot relative to the rest of the container, whereby the support member may be pivotted and moved between any of the plurality of stacking positions. The mounting means may allow the pivot axis to move, for instance relative to the container or relative to the support member.

The mounting means may be so formed as to tend to resist movement of the pivot axis when the support member is in at least one of the positions, whereby the number of the said positions accessible by the support member is restricted unless the resistance is overcome. The support member can preferably only move between a first stacking position and a nesting position unless the resistance is overcome. The first stacking position may be the uppermost stacking position. The resistance may be provided by a resilient detent formation which must be moved against its associated resilience to allow the pivot axis to pass.

Preferably the container incorporates a surface which is so oriented as to urge the pivot axis to move to a preferred position relative to the container, when the support member is in one of the said positions. Preferably the said one position is the nesting position. Preferably the said surface is provided by a wall of the container. The surface and the support member may be so formed as to require the pivot axis to have a pre-set position when the support member is in the said one position. The pre-set position may correspond with the nesting position.

The mounting means may be so formed as to allow the pivot axis to be moved while the support member is in the resting position, to a position corresponding to a selected stacking position and at which the support member may swing from the nesting position to the selected stacking position without further movement of the pivot axis.

Preferably, the mounting means comprise a slot, which is preferably arcuate, the pivot axis being movable along the slot. If the slot is arcuate, it is preferably centred at the nesting position. The slot may be formed in a container wall. Alternatively, there may be a pivot member fixed in relation to the container wall, and located in a slot which is movable with the support member. Preferably the mounting means incorporates a resilient detent formation so located as to bear on a part moving along the slot. The detent formation may be formed in a wall of the slot. The resilience may be provided by the material of the wall of the slot.

Preferably the support member comprises at least one first portion locatable in the slot of the mounting means to be pivotable within and movable along the slot, and a second portion which extends across the container to support a second like container when in the stacking position. The support member may further comprise one or more connecting portions to connect the second portion to the or each first portion. The support member is preferably substantially U-shaped, and may be comprised of metal and/or reinforced plastics material or other suitable material.

Preferably corresponding mounting means are provided at opposite walls of the container.

Preferably, the container is adapted to retain the support member in each of the stacking positions. The container may comprise a formation at each stacking position, each formation being so formed as to retain the support member in the corresponding stacking position. Each formation may comprise a notch in which the support member may rest. The support member may comprise a projection which enhances engagement between the support member and the retaining formation. The formations are preferably formed in side walls of the container.

Preferably, a channel forming member is provided adjacent the side walls of the container, to form a generally open-topped channel. The mounting means may be provided in one or both channel walls. The mounting means may comprise a slot in one or both channel walls, and corresponding portions of the support member locatable in the slot or slots.

Preferably a plurality of support members are provided. Preferably two support members are located toward respective ends of the container, each being mounted as aforesaid.

The container preferably has a base and walls extending above the base.

BRIEF DESCRIPTION OF THE DRAWINGS

Embodiments of the present invention will now be described in more detail, by way of example only, and with reference to the accompanying drawings, in which.

DESCRIPTION OF PREFERRED EMBODIMENTS

Figure 1:
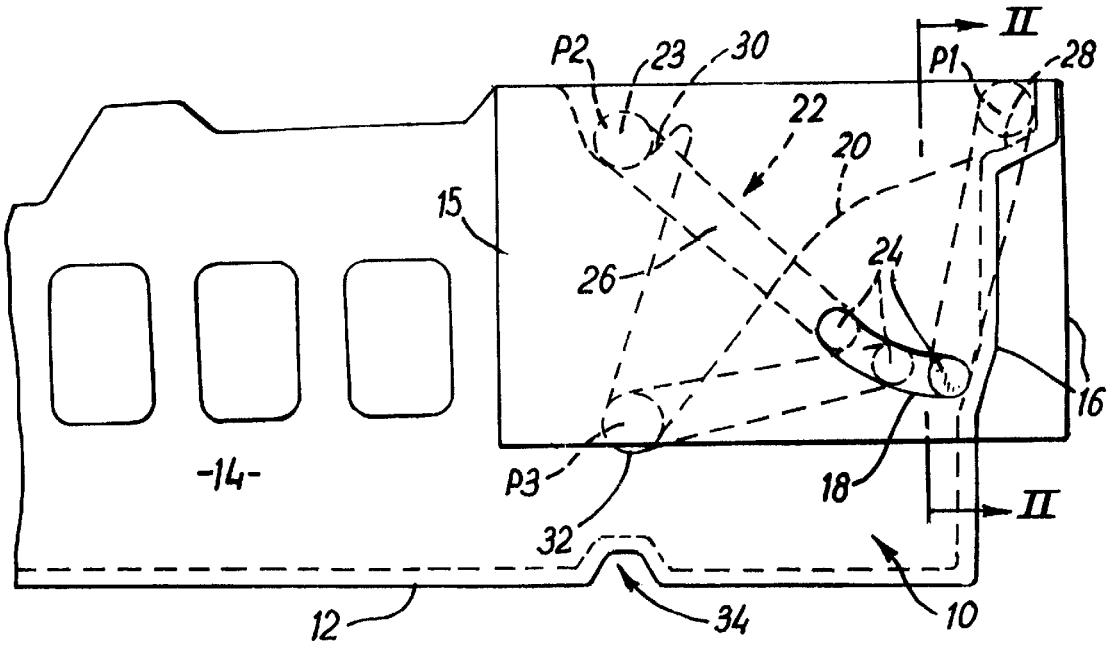
FIG. 1 is a diagrammatic side elevation of part of one end of a container according to the present invention, showing a support member in three alternative positions.
Figure 2:
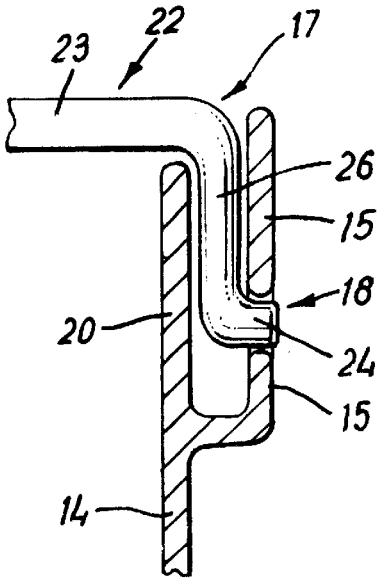
FIG. 2 is a diagrammatic cross-section of a first type of pivotal connection viewed along the line II—II in FIG. 1 with details of the end wall omitted, for clarity.
Figure 3:
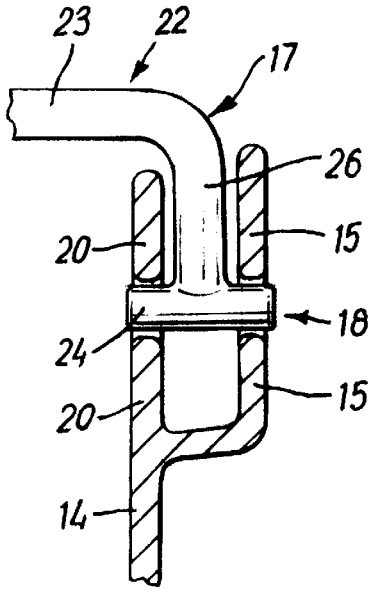
FIG. 3 is a similar diagrammatic cross-section of a second type of pivotal connection.

Turning to FIG. 1, a container 10 comprises a base 12 and four upstanding walls of which part of a side wall 14 and an end wall 16 can be seen in FIG. 1. The walls are formed to allow containers to nest inside each other, subject to the location of support members, as will be described. Both side walls 14 comprise an outer channel forming member 15 (see particularly FIGS. 2 and 3) extending adjacent thereto, to form an upwardly open channel 17. Alternatively, the channel and channel forming member could be adjacent the inner face of the wall 14. Corresponding slots 18 are provided in the channel 17 in each member 15. The slots 18 are shown as arcuate, but may be straight. FIG. 2 shows the slot 18 formed in the channel forming member 15. Alternatively, the slot 18 may be formed at the corresponding height in the channel forming portion 20 of the side wall 14. In a further alternative (FIG. 3) a slot 18 is formed in the channel forming member 15 and also in the well portion 20.

A support member 22 is provided which comprises a support bar 23 which extends across the upper mouth of the container 10, between the side walls 14, and which further comprises an end portion 24 at each end thereof. The end portions 24 are located within corresponding slots 18. Connecting portions 26 connect the respective ends of the support bar 23 to the respective end portions 24, such that the support member 22 is generally U-shaped (generally inverted when in position in the container). The support member 22 may be of metal, or reinforced plastics material, or other suitable material having adequate strength.

The location of the end portions 24 in the slots 18 serves to mount the members 22 on the container and allows the members 22 to pivot about the axis of the end portions 24 (parallel to the bar 23). The end portions 24 may also slide along the slots 18 to move the pivot axis relative to the container.

Corresponding sets of recesses 28,30,32 are formed in the walls 14 of the container. A recess 28 is formed at the top of each end wall 16 and recesses (or notches) 30,32 are formed in the channel forming portion 20 of each side wall 14. The recesses 28,30,32 are so formed as to be able to engage the support bar 23, to support the support bar 23 at a fixed position and pre-determined height above the base 12.

The other end of the container (not shown, but to the left as viewed in FIG. 1) has a corresponding support bar arrangement.

In use, when a similar container is to be nested in the container 10, each support member 22 is in position P1, with each support bar 23 in the respective recess 28, adjacent the respective end wall 16. The end portions 24 are at the lower ends of the slots 18. They will tend to adopt this position by the influence of gravity. In this position, the support bars 23 do not obstruct the entry of the base of a similar container into the container 10, and therefore allow the similar container to be nested with the container 10.

When a similar container is to be stacked on top of the container 10 at a relatively large height above the base 12 (that is, the containers are to be stacked relatively far apart), then the support members 22 are moved from position P1 to position P2 wherein the support bars 23 are located in the respective recesses 30. It can be seen that in order for each bar 23 to be located in the respective recess 30, the support member 22 must be both pivotted about the end portions 24 and the end portions 24 moved along the slots 18. When in position P2, the support bars 23 extend across the container to provide a support for the base of a similar container thereby supporting the similar container at a relatively large height above the base 12. The container 10 may have a stacking notch 34 in its base, to locate securely on a support bar 23 below.

If the vertical distance between stacked containers is desired to be relatively small, then the support members 22 can be moved to position P3, in which the respective support bars 23 rest in the respective recesses 32. Again, moving the members 22 into this position (either from position P1 or P2) requires a combination of pivotal movement of the members 22 about the portions 24 and movement along the slots 18.

Movement between the nesting position P1 and the various stacking positions is facilitated by having the slot 18 arcuate and centred on the axis of the bar 23 when at the nesting position P1. A stacking position can then be selected by pivotting the portions 26 about the bar 23, to move the portions 24 along the slot 18 to a position which allows pivotting about the portions 24 to swing the bar 23 into notch 30 or 32.

The final positions of the bar 23 in the notches 30,32 are vertically aligned, but alternatively could be vertically offset. A number of positions, some vertically aligned and some offset, could be provided.

It is to be appreciated that any suitable number of recesses can be provided according to the number of different stacking heights required. It should also be understood that the Figures indicate support members occupying each of the positions P1,P2,P3 simultaneously, whereas, of course, only one position would be in use at any time.

Figure 4:
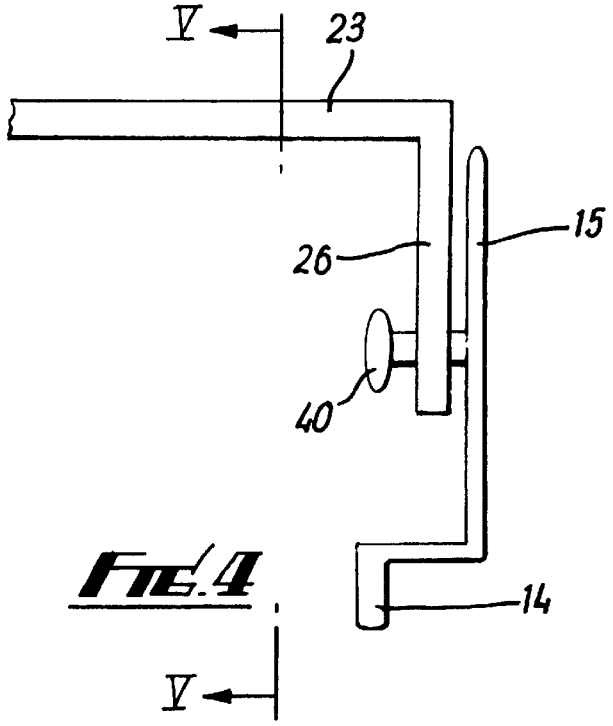
FIG. 4 is a similar diagrammatic cross-section of a third type of pivotal connection.
Figure 5:
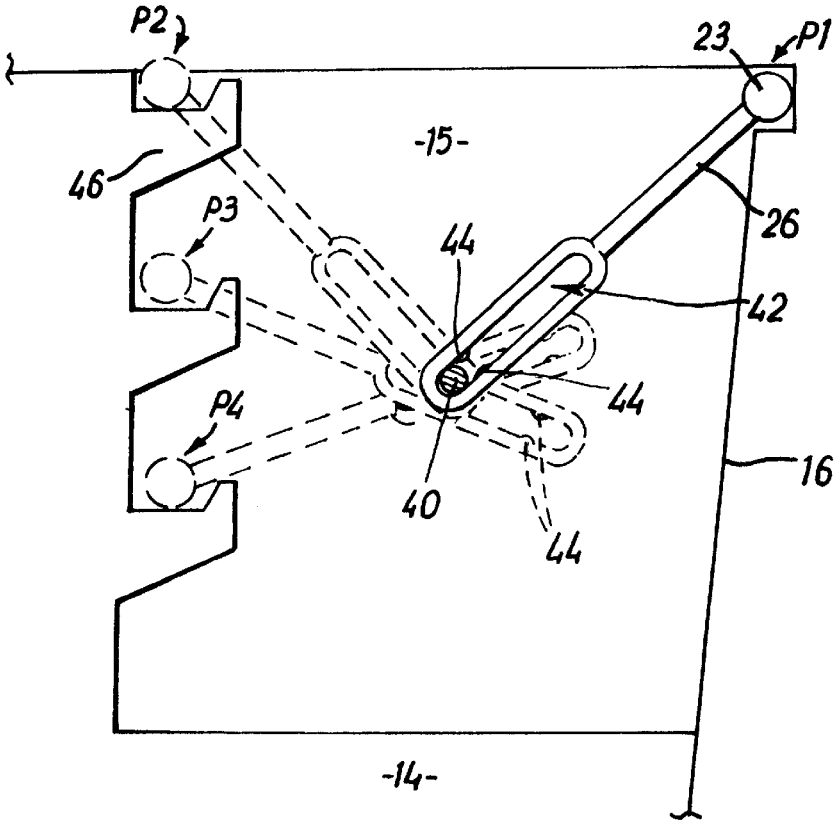
FIG. 5 is an elevation of the container wall corresponding to FIG. 1, viewed from inside the container along the line V—V of FIG. 4, and showing the use of the pivotal connection of FIG. 4.

Another alternative arrangement for mounting the support bar 23 on the container is illustrated in FIGS. 4 and 5. In this arrangement, a fixed lug or pin 40 is mounted on or formed integrally with the container wall. The connecting portion 26 has an elongate slot 42 in which the lug 40 is located. The lug and slot provide a pivotal connection between the support member 23 and the container 10. Movement of the lug 40 along the slot 42, as will be described, allows the pivot axis to move relative to the support member. Small resilient fingers 44 may be formed in the walls of the slot 42 to resist movement of the lug 40 along the slot 42 unless the resilience is overcome. In order to allow the resilience to be overcome, the fingers 44 may be inherently resilient, or the material in which the slot is formed may be resilient, or both.

Preferably the fingers 44 confine the lug 40 to one end (the lower end) of the slot 42. If the resilience is not overcome, the support member 23 is then free to swing between the nesting position P1 and the uppermost stacking position P2 at which the support member 23 rests in a hooked notch 46 to be retained in position.

FIG. 5 shows two other positions P3 and P4 which are lower stacking positions and are shown vertically aligned with position P2 but could be arranged in other ways. A support bar 23 can be placed in positions P3 or P4 in the following manner. The bar 23 is first swung out from position P1 or position P2 to an intermediate position and a downward force is applied to overcome the resilience in the slot 42 until the lug 40 clears the fingers 44 and is located above them in the slot. By sliding the connecting portion 26 up or down on the lug 40, and by pivotting the support bar 23 and connecting portion 26 about the lug 40, the support bar 23 can be moved to position P3 or P4. Thus, the support bar 23 can be moved between any of the positions P1, P2, P3 and P4 by appropriate pivotal movement about the lug 40, and movement of the pivot axis relative to the support bar 23 along the slot 42.

For some applications, it may be desirable to provide more resilient fingers at other positions, or to provide no resilient fingers.

Figure 6:
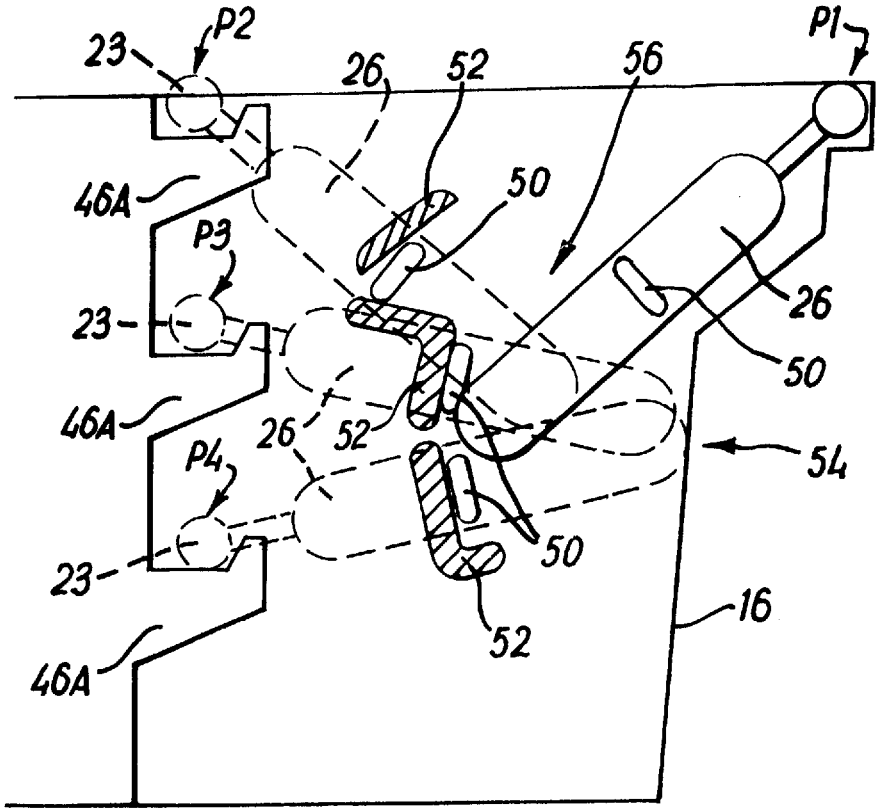
FIG. 6 is an elevation corresponding to FIG. 5, showing a further type of pivotal connection.

FIG. 6 shows a further alternative arrangement for mounting the support bar 23 on the container 10. The illustrated arrangement provides three stacking positions P2,P3,P4 at different heights. A hook formation 46A is provided at each stacking position to receive the bar 23. For convenience of description, a support bar 23 and connecting portion 26 are shown in each of the three stacking positions and at the nesting position but naturally, only one position would be occupied at any one time.

In this arrangement, each connecting portion 26 carries a land 50. The container walls carry lands 52. If the support bar 23 is moved to certain positions relative to the container 10, the land 50 will contact one or other of the lands 52, thereby preventing further movement. In other positions, the connecting portion 26 will engage the container end wall 16 as can be seen at 54. The shape and position of the lands 52 and the land 50 are chosen to confine the land 50 during normal use to a region 56 between the lands 52 and the end wall 16. Alternatively, a ring of lands 52 could be used to confine the land 50 and avoid the need for any contact with the wall 16 to assist in the confinement. It is to be noted that the region 56 is not delimited by a continuous wall. Alternatively, a continuous wall could be used. The positions of the lands 50,52 could be reversed, so that a land or other projection fixed on a container wall is confined in a region defined relative to the connecting portion 26. The effect of the confinement of the land 50 limits the land 50 to a predetermined range of locations. Since the land 50 moves with the support bar 23, the support bar 23 is therefore also limited in its range of movement. This allows the support bar 23 to move between stacking positions (and a nesting position, if one is provided) but retains the support bar 23 loosely mounted on the container. In effect, while the slots of FIGS. 2,3 and 4 allow the corresponding pivot axis to move along a line, the confinement in the region 56 allows the pivot axis to move in two dimensions around the region 56. Thus, while the connecting member 26 is more loosely mounted on the container in FIG. 6, it is nevertheless mounted to allow the support bar to move between stacking positions by a combination (possibly a complicated combination) of linear and pivotal movement.

Figure 7:
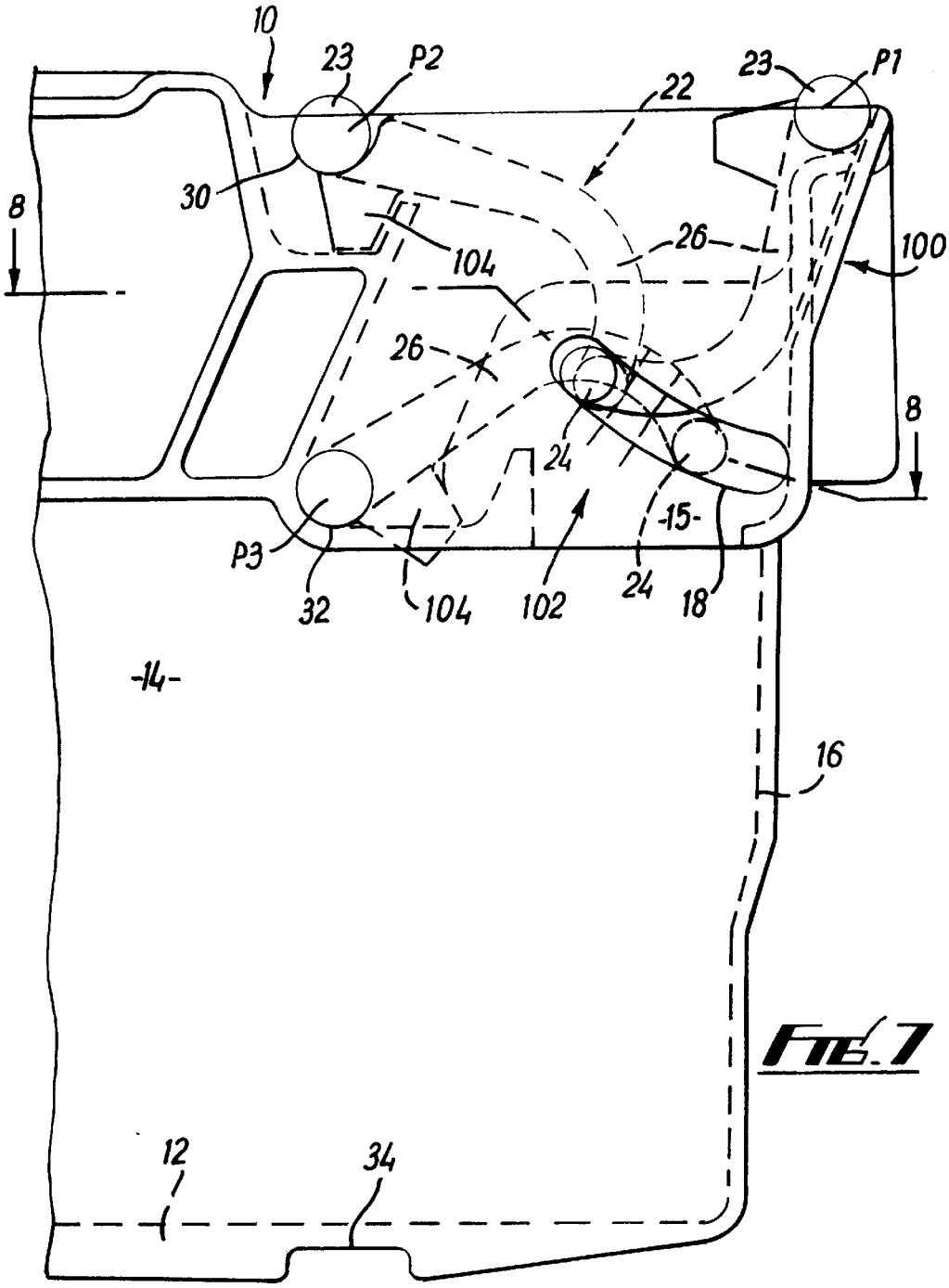
FIG. 7 is a side view corresponding to FIG. 1, showing a second embodiment.
Figure 8:
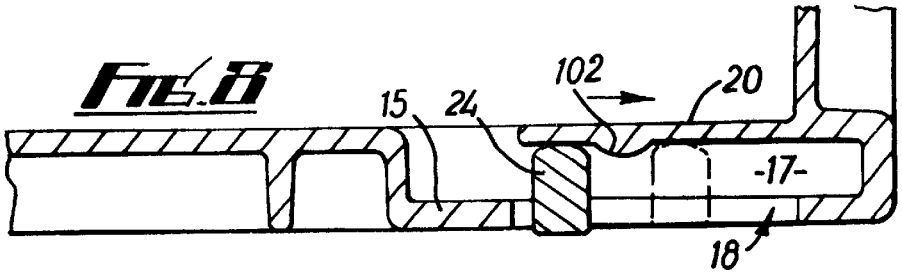
FIG. 8 is a partial plan view, in section, along the line 8—8 of FIG. 7, with parts cut away.

A second embodiment is shown in FIGS. 7 and 8. This embodiment corresponds closely with the first embodiment described above, particularly that shown in FIGS. 1 to 3, and corresponding numerals are used, where applicable. However, the connecting portions 26 are arcuate rather then straight. The end wall 16 slopes less steeply in the region indicated by numeral 100. The sliding pivot mounting of the connecting portions 26 incorporates a detent, as will be described. These differences will now be described in more detail.

The connecting portions 26 and the wall region 100 are formed so that the connecting portions 26 lie along the wall portion 100 when the support member 22 is in the nesting position P1. In this position, the curve on the connecting portions 26 places the end portions 24 at or near the upper end of the slots 18. This position corresponds to the position at which the support member 22 can swing (without the pivot axis moving along the slot) between the nesting position and the uppermost stacking position P2. These two positions are likely to be the most frequently used, and correspond to the nesting and stacking positions of conventional nest/stack containers.

The mounting arrangement of the support members 26 tends to resist movement of the end portions 24 along the slots 18, away from this upper position. The resistance is provided by a resilient detent formation 102, shown most clearly in FIG. 8. The location of the formation 102 is indicated in FIG. 7 by a pair of broken lines. The formation 102 is a prominence formed in the rear wall 20 of the slot 18. Alternatively, the formation could be flush with the rear wall 20, the end portion 24 moving normally in a groove to either side of the formation 102. Other detent arrangements could be used, and appropriate resilience can be provided in various ways.

The formation 102 provides resilient resistance to movement of the end portion 24, which can only move along the slot 18 past the formation 102 if the resilience is overcome, for instance by flexing the material of the rear wall 20 and/or the channel forming member 15.

The presence of the formation 102 tends to retain the end portion 24 to one side or the other of the formation 102. In many applications, it is expected that the end portion 24 will normally be located between the formation 102 and the upper end of the slot 18, in the position corresponding to the nesting position P1 and the upper stacking position P2. The support member 22 can be moved easily from the nesting position to the upper stacking position and back, while the end portion 24 is retained at the corresponding position by the formation 102. It is to be noted that the geometry is such that forces applied to the support member 22 when in the stacking position P2 or the nesting position P1, cannot force the end portion 24 past the formation 102. This is a result in particular of the abutment of the connecting portions 26 and the wall section 100, together with the curvature of the connecting portions 26.

The security of the arrangement at the positions P2,P3 can be enhanced by deepening the notches in relation to FIG. 1, as shown, and providing projections 104 which engage the deepened notches.

If it is required to place the support member 22 in the lower stacking position P3, the support member 22 should be moved by hand to an intermediate position between the nesting position and the upper stacking position, at which position a downward force can be applied to force the end portions 24 past the formations 102, against the resilience of the wall 20. Once the end portion 24 has been forced past the formation 102, the location of the pivot axis of the support member 22 changes, as has been described above in relation to FIGS. 1 to 6, and the support member 22 can then be pivotted down to the lower stacking position P3. If it is desired to return the support member 22 to the upper stacking position or to the nesting position, the support member 22 is again raised to the intermediate, substantially upright position and an upward force is applied to pull the end portions 24 past the formations 102 to the upper positions corresponding to the nesting position and the upper stacking position. Alternatively, this upward force can be provided by a form of camming action in which the support member 22 is swung from the lower stacking position toward the nesting position, until bearing against the wall section 100. A sideways force, such as by placing a second container down into the mouth of the container, or applied by hand, would then force the support bar 23 outwardly and force the connecting portions 26 against the wall section 100, thereby exerting an upward force on the end portions 24, by virtue of a form of camming or levering action. This would force the end portions 24 past the formations 102.

Figure 9:
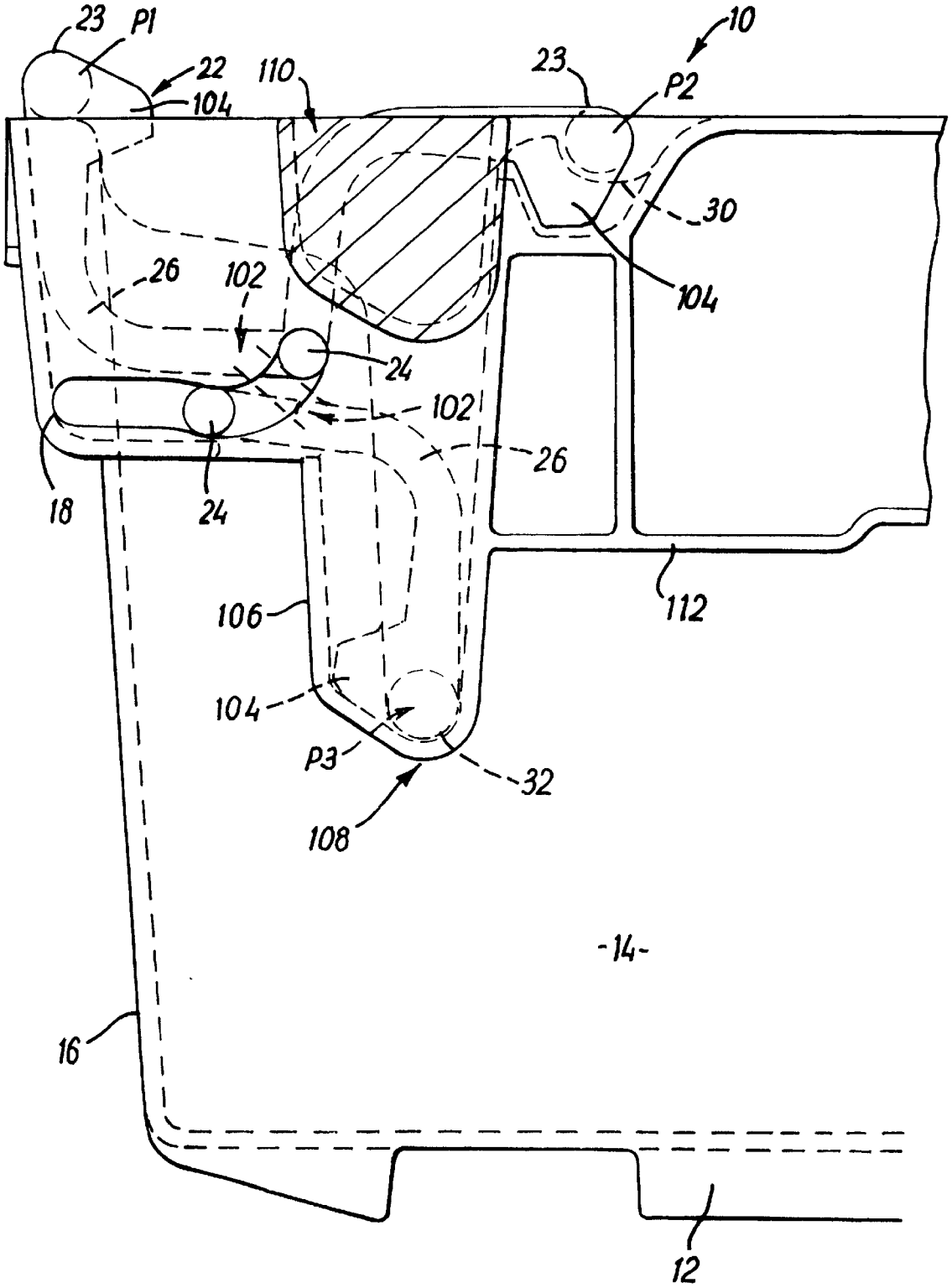
FIG. 9 is a side view showing a third embodiment and corresponding to FIG. 1, but showing the opposite end of the container.

A further embodiment is shown in FIG. 9. This embodiment corresponds closely to the embodiment of FIGS. 7 and 8 and again has many features in common with the first embodiment described above, particularly in relation to FIGS. 1 to 3. Corresponding numerals are therefore used. The embodiment of FIG. 9 again incorporates a detent formation at 102 to resist movement of the end portions 24 from the positions corresponding to the nesting position P1 and upper stacking position P2 of the support member 22.

The lower stacking position P3 of the embodiment of FIG. 9 is much lower than the corresponding position in FIG. 7 and is not in vertical alignment with the upper stacking position P2. These two differences cause a consequent modification in the shape of the slot 18 below the detent formation 102. In FIG. 9, in common with other embodiments described above, the connecting portions 26 reach down to the lower stacking position in wall recesses which open into the inside of the container. These recesses are sufficiently deep to act as the notches 32, and are formed by outwardly projecting wall portions 106. Because the lowest stacking position is so low, the lowest projection on the side wall of the container is therefore at the location indicated by the numeral 108, slightly below the lower stacking position P3. Normally, a container of this nature stacks by locating the lowest projection at the upper edge of the side wall of a container below. If that were to occur with the container of FIG. 9, only a relatively small part (less than one half) of the container would in fact nest in the container below. The compactness of a set of nested containers (the nest factor) can be increased by further projecting the wall outwardly, in the shaded region at 110. This provides a region which can receive the region at 108 of a similar container, below the top edge of the side wall. Consequently, the container can nest further into a container below, until a rib 112 on the side wall makes contact with the upper edge of the side wall.

Various modifications may be made without departing from the spirit or scope of the present invention. For example, the slots can be of any suitable shape, and may be substituted for any other suitable mounting means, for example runners. The pivotal attachment of the support member to the sides of the container may be of any suitable design. A single support member may be provided in a container, and adapted to sufficiently support a container stacked therein.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A container for use in a stackable/nestable container assembly, said container comprising:

(a) a plurality of attached side walls, an open top, and a base;

(b) first and second elongated, spaced-apart support members extending between an opposing two of said plurality of side walls for engaging and supporting an adjacent container of like dimensions in a stacked condition;

(c) adjustable mounting means for attaching each of said first and second support members to the opposing side walls for corresponding adjustable movement between a plurality of container supporting positions; and (d) at least two of said container supporting positions of said first and second support members being in spaced vertical alignment with each other for adjusting the vertical stacking height of the adjacent, stacked container.

2. The container of claim 1, wherein said first and second support members have a corresponding nesting position in which the support members allow the second like container to be nested in said first container.

3. The container of claim 1, wherein said mounting means include a projection which is confined, in use, to a predetermined range of locations to limit the range of movement of said support member.

4. The container of claim 3, wherein said projection is confined by surfaces which do not continuously bound the region in which said projection is confined.

5. The container of claim 1, wherein said mounting means allow said support member to pivot about a pivot axis relative to the rest of said container, whereby said support member is able to pivot and move between any of said plurality of container supporting positions.

6. The container of claim 5, wherein said mounting means allow said pivot axis to move.

7. The container of claim 6, wherein said pivot axis is movable relative to one of said container and said support member.

8. The container of claim 6, wherein said mounting means comprise detent means which tend to resist movement of said pivot axis when said support member is in at least one of said positions, whereby the number of the said positions accessible by said support member is restricted unless the pivot axis is released from the detent means.

9. The container of claim 8, wherein said support member can only move between a first stacking position and a nesting position unless the pivot axis is released from the detent means.

10. The container of claim 9, wherein said first stacking position is an uppermost of said stacking positions.

11. The container of claim 8, comprising a resilient detent formation which must be moved against its associated resilience to allow said pivot axis to pass.

12. The container of claim 5, and incorporating a surface which is so oriented as to urge the pivot axis to move to a preferred position relative to said container when said support member moves to one of the positions.

13. The container of claim 12, wherein said one position is a nesting position.

14. The container of claim 13, wherein said surface is provided by a wall of said container.

15. The container of claim 5, wherein said mounting means are so formed as to allow said pivot axis to be moved while said support member is in a nesting position to a position corresponding to a selected stacking position and at which said support member may swing from said nesting position to said selected stacking position without further movement of said pivot axis.

16. The container of claim 1, wherein said mounting means comprise a slot, said pivot axis being movable along said slot.

17. The container of claim 16, wherein said slot is arcuate.

18. The container of claim 17, wherein said slot is centered at said nesting position.

19. The container of claim 16, wherein the slot is formed in a container wall.

20. The container of claim 16, wherein a pivot member is fixed in relation to the container wall and located in a slot which is movable with said support member.

21. The container of claim 16, wherein said mounting means incorporates a resilient detent formation so located as to bear on a part moving along said slot.

22. The container of claim 21, wherein said detent formation is formed in a wall of said slot.

23. The container of claim 21, wherein said resilience is provided by material of said wall of said slot.

24. The container of claim 16, wherein said support member comprises at least one first portion locatable in said slot of said mounting means to be pivotable within and movable along said slot, and a second portion which extends across said container to support the second like container when in a stacking position.

25. The container of claim 24, wherein said support member comprises at least one connecting portions each connecting said second portion to a corresponding first portion.

26. The container of claim 24, wherein said support member is substantially U-shaped.

27. The container of claim 5, wherein corresponding mounting means are provided at opposite walls of the container.

28. The container of claim 1, wherein said container is adapted to retain said support member in each of said stacking positions.

29. The container of claim 28, comprising a formation at each said stacking position, each said formation being formed to retain said support member in the corresponding stacking position.

30. The container of claim 29, wherein each said formation comprises a notch in which said support member may rest.

31. The container of claim 29, wherein said support member comprises a projection which enhances engagement between said support member and said retaining formation.

32. The container of claim 29, wherein said formations are formed in side walls of said container.

33. The container of claim 1, wherein a channel forming member is provided adjacent side walls of said container to form a generally open-topped channel.

34. The container of claim 33, wherein mounting means for said support member are provided in one or both channel walls.

35. The container of claim 34, wherein said mounting means comprise a slot in one or both channel walls, and corresponding portions of said support member locatable in said slot or slots.

36. The container of claim 1, comprising a plurality of support members.

37. The container of claim 36, wherein two support members are located toward respective ends of said container, each being mounted as aforesaid.

* * * * *